United States Patent [19]

Tatsumi et al.

[11] 4,102,123

[45] Jul. 25, 1978

[54] BEARING FOR A TIMEPIECE TRAIN

[75] Inventors: Yoshio Tatsumi; Eiichi Matsuura; Keikichi Takahashi; Nobuo Tsukada, all of Tokyo, Japan

[73] Assignee: Kabushiki Kaisha Daini Seikosha, Japan

[21] Appl. No.: 751,073

[22] Filed: Dec. 16, 1976

[30] Foreign Application Priority Data

Dec. 17, 1975 [JP] Japan ..... 50-170839

[51] Int. Cl.[2] ..... G04B 29/00; G04B 33/00; G04B 31/00

[52] U.S. Cl. ..... 58/140 R; 58/52 R; 58/59

[58] Field of Search ..... 58/140 A, 23 D, 28 D, 58/52, 59, 140 R

[56] References Cited

U.S. PATENT DOCUMENTS

| | | | |
|---|---|---|---|
| 2,366,196 | 1/1945 | Kappes | 58/140 R |
| 3,324,646 | 6/1967 | Schneider | 58/140 R |
| 3,732,685 | 5/1973 | Haydon | 58/23 D |

*Primary Examiner*—Edith S. Jackmon
*Attorney, Agent, or Firm*—Robert E. Burns; Emmanuel J. Lobato; Bruce L. Adams

[57] ABSTRACT

A timepiece has a wheel and pinion mechanism having upper and lower shafts rotatably mounted in bearings which are fixed in a pair of spaced apart plates. The bearing fixed in one plate has a cylindrical portion which surrounds the pinion portion of the wheel and pinion mechanism and which is spaced therefrom a slight distance which is sufficiently small to enable the pinion portion to abut the inner wall of the bearing cylindrical portion in the event the wheel and pinion mechanism tilts on its lower shaft a predetermined amount from its intended orientation thereby preventing falling of the mechanism during assembly.

2 Claims, 1 Drawing Figure

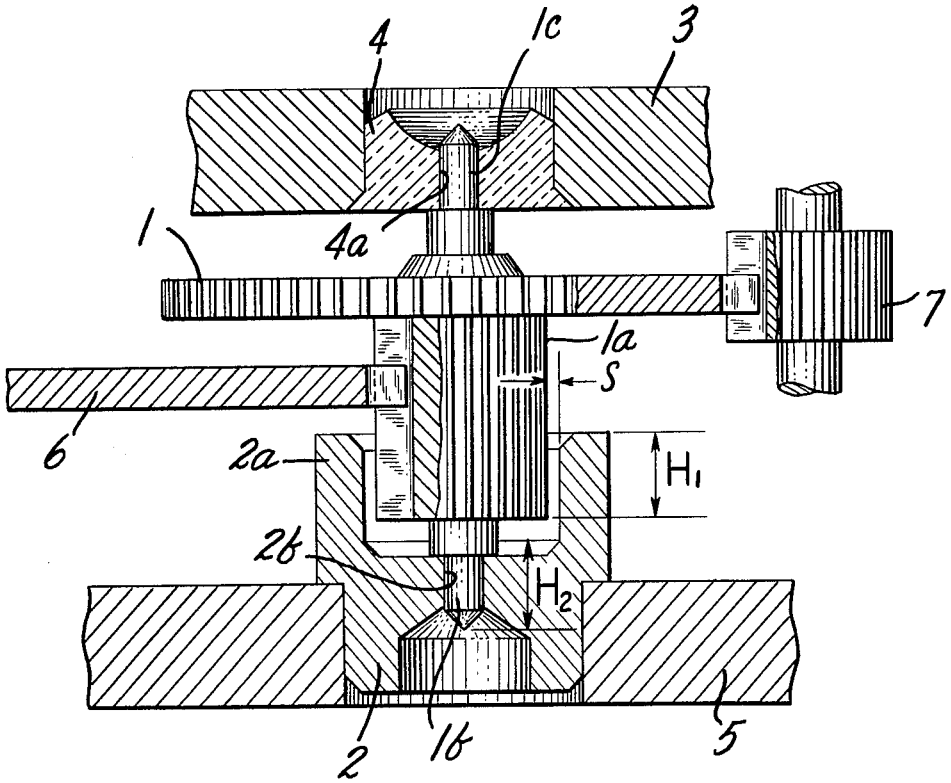
4
1c
3
4a
1
7
1a
S
6
2a
H1
2b
H2
2
1b
5

BEARING FOR A TIMEPIECE TRAIN

BACKGROUND OF THE INVENTION

This invention relates to a bearing for a timepiece gear train and, more particularly to a technique to improve the assembly of the gear train.

Conventionally, the assembly of a wheel and pinion mechanism and a bridge requires a great deal of skill and time since the wheel and pinion mechanism generally maintains the equilibrium in a given vertical orientation during assembly at its upper potion and can easily fall or tilt from the vertical because of unstability when the wheel and pinion mechanism is set in a base plate. As a countermeasure, members between the base plate and the bridge or a concave portion of the base plate are approximated to the wheel and pinion mechanism. However, in consideration of the play of the wheel and pinion mechanism, a relatively wide gap is required and if the gap is not large enough the wheel and pinion mechanism will contact the approximated members and disturb the rotation of the wheel and pinion mechanism. Moreover, the configuration of such members and of the concave portion of the base plate are complicated and result in a rise in the price of manufacture. Furthermore, as for small-sized women's watches, the above mentioned countermeasures cannot be taken because of lack of available space.

The present invention aims to simplify the train construction and assembly of the gear without a rise in the cost of manufacture by eliminating the above mentioned difficulty and insufficiency, the substance of which is to prevent falling or tilting of the wheel and pinion mechanism by means of a specially shaped bearing of the train.

Hereinafter the present invention will be illustrated in detail.

BRIEF EXPLANATION OF THE DRAWING

The single FIGURE is a sectional view showing the essential parts of the gear train assembly of the present invention.

DETAILED DESCRIPTION OF PREFERRED EMBODIMENT

According to the drawing, a bearing 2 is set in a base plate 5 which supports a lower shaft 1*b* of a wheel and pinion mechanism 1. The bearing 2 is provided with a cylindrical portion 2*a* which surrounds the outer diameter of a pinion portion 1*a* of the wheel and pinion mechanism 1 maintaining a slight gap S between the cylindrical portion 2*a* and pinion mechanism 1. Tilting or falling of the wheel and pinion mechanism 1 before the bearing carrier 3 is assembled during assembly of the gear train is controled and maintained small by the minute gap S defined by the cylindrical portion 2*a*. By such a construction, an upper shaft 1*c* of the wheel and pinion 1 mechanism can be easily inserted into a hole 4*a* of a bearing 4 which is mounted in the bearing carrier 3. The width of the gap or space S is selected as small as possible and is chosen in consideration of the outer diameter of the pinion portion 1*a* of the wheel and pinion mechanism 1 and the inner diameter of the cylindrical portion 2*a* of the bearing 2 so that the space S is minimized to the extent the pinion portion 1*a* and the cylindrical portion 2*a* do not contact each other but are closely disposed. As a result, the extent of possible tilt or lean of the wheel and pinion mechanism 1 is exceedingly minimized since the pinion portion 1*a* will abut the inner wall of the cylindrical portion 2*a* whenever the mechanism 1 tilts slightly from the vertical thereby maintaining the given vertical orientation of the mechanism 1 within a small, predetermined range.

On the other hand, if the extent of the overlapped portion $H_1$ of the cylindrical portion 2*a* and the pinion portion 1*a* is increased and made greater than the length of the lower $H_2$ 1*b* of the shaft wheel and pinion mechanism 1, the overlapped portion $H_1$ facilitates insertion of the lower shaft 1*b* into the hole 2*b* of the bearing 2 as the cylindrical portion 2*a* acts as a guide for the mechanism 1.

Materials for the bearing 2 may be metal or plastic having suitably low coefficient of friction and if plastic is employed, the cylindrical portion 2*a* can be easily formed by injection molding.

As illustrated, according to the present invention, the gear train can be easily assembled without any rise in the price of manufacture.

We claim:

1. In a timepiece: a base plate; a wheel and pinion mechanism comprised of integral wheel and pinion portions having upper and lower shafts extending outwardly therefrom; and means mounting said wheel and pinion mechanism on said base plate for rotation in a given orientation relative to said base plate comprising means defining an opening in said base plate, and a bearing having a base portion fixedly inserted into said opening and an elongated hole in said base portion rotatably receiving therein said lower shaft of said wheel and pinion mechanism and having a cylindrical portion surrounding the outer periphery of said pinion portion and being spaced therefrom along their respective axial lengths a predetermined distance effective to enable said pinion portion to abut the inner wall of said bearing cylindrical portion when said wheel and pinion mechanism tilts on its lower shaft a predetermined amount from said given orientation thereby preventing falling of said wheel and pinion mechanism and maintaining it substantially in said given orientation while otherwise avoiding contact between said bearing cylindrical portion and said pinion portion when said wheel and pinion mechanism is in said given orientation.

2. A timepiece according to claim 1; wherein said bearing cylindrical portion has a length approximately equal to the axial length of said lower shaft.

* * * * *